US006345392B1

(12) United States Patent
Rios

(10) Patent No.: US 6,345,392 B1
(45) Date of Patent: Feb. 12, 2002

(54) DISPOSABLE GARMENT-PROTECTING COVER FOR USE WHEN HOLDING INFANTS

(76) Inventor: Fermina Rios, 23 Argos, Laguna Niguel, CA (US) 92677

( * ) Notice: Subject to any disclaimer, the term of this patent is extended or adjusted under 35 U.S.C. 154(b) by 0 days.

(21) Appl. No.: 09/835,760

(22) Filed: Apr. 16, 2001

(51) Int. Cl.[7] ..... A41B 13/10; A41D 13/04; A41D 1/22

(52) U.S. Cl. ..... 2/48; 2/49.1; 2/104

(58) Field of Search ..... 2/48, 46, 49.1, 2/49.2, 49.4, 50, 51, 52, 104, 88, 89

(56) References Cited

U.S. PATENT DOCUMENTS 2,164,369 A * 7/1939 Woolever ..... 2/49
2,423,581 A * 7/1947 Clark ..... 2/49
2,580,388 A * 1/1952 Allen ..... 2/49
2,742,644 A * 4/1956 Kaufman ..... 2/49
3,619,816 A * 11/1971 Cowen ..... 2/49
3,747,122 A * 7/1973 Goldberg ..... 2/48
3,945,048 A * 3/1976 Shearer ..... 2/49 R
4,660,226 A * 4/1987 Quillin et al. ..... 2/49 R
4,924,527 A 5/1990 Hintermeyer
5,100,710 A 3/1992 Rizzuto
5,459,877 A * 10/1995 Roberti ..... 2/104
5,477,560 A * 12/1995 Shope ..... 2/49.1
5,809,568 A 9/1998 Morris-Jones
5,822,792 A * 10/1998 Reinhart, Jr. ..... 2/49.1
5,842,228 A * 12/1998 Krainin ..... 2/46
5,950,235 A * 9/1999 Tata ..... 2/48
6,049,909 A * 4/2000 Anderson ..... 2/49.1

* cited by examiner

*Primary Examiner*—Amy B. Vanatta
(74) *Attorney, Agent, or Firm*—Edgar W. Averill, Jr.

(57) ABSTRACT

A disposable garment-protecting cover having a flexible, foldable sheet construction is provided for use when holding a baby against one's shoulder. The sheet construction has upper, lower, and middle regions which are preferably folded therebetween to cover a user's upper back, chest, and shoulder areas, respectively. The middle region has a central aperture through which a user's neck may be extended, and the lower region includes at least two vertical creases which fold the resulting vertical sections toward a back surface of the sheet construction, such that when the garment-protecting cover is donned, the lower region contours to the user's chest.

14 Claims, 3 Drawing Sheets

DISPOSABLE GARMENT-PROTECTING COVER FOR USE WHEN HOLDING INFANTS

BACKGROUND OF THE INVENTION

The field of the invention generally pertains to garment protecting covers. The invention relates more particularly to a disposable protective cover for use when holding infants, particularly when holding an infant against a user's shoulder to burp the infant. The protective cover has horizontally sectioned lower, middle and upper regions which cover and protect a user's chest, shoulders, and upper back, respectively, and utilizes vertical creases to produce a concave configuration of at least the lower region for contouring to the user's chest.

Oftentimes when holding a baby, especially a newborn infant, the baby will drool, stain, soil or otherwise dirty the clothes of a person holding the baby. In particular, babies are notorious for regurgitating foods on the shoulder of a parent or individual burping the baby after a meal. The cautious parent or other adult will therefore often place a small towel, tissue, cloth or other generally flexible sheet-like structure over one shoulder as a protective measure against such mishaps.

However, it is often common to reposition the baby from time to time from one shoulder to the other, to prevent fatigue on any one shoulder. This requires either the repositioning of the protective towel or cloth every time a shift is made, or using a second towel or cloth. In either case, the towels and cloths are simply slung over the shoulder without securing it in some manner to the user to keep it from falling off. Moreover, repositioning a single towel to the other shoulder while holding a baby can be an awkward endeavor which unnecessarily risks the safety of the baby. Because of these and other inconveniences associated with the use of such protective towels and cloths, parents oftentimes do not bother using them altogether.

Several prior art apparatuses, such as bibs and bib-like sheet structures are known which serve to provide a similar garment protecting function to that of the small towels and cloths used in a manner discussed above.

For example, in U.S. Pat. No. 5,809,568, a disposable bib is shown formed from two sheets of absorbent material and separated by perforations. Alternate sheets have a flap which may be released from one of the sheets and folded to overlie or underlie the other sheet. In this manner, a neck-receiving opening is formed between two retaining strips which are used to tie the bib to a user. Another example is shown in U.S. Pat. No. 4,924,527 disclosing a garment protector made of a flexible material and having neck portions 39 and 40 which are extendable around a user's neck and fastened by snap fasteners. In both of these designs, minimal or modest coverage is provided to the shoulder areas due to the relatively narrow shoulder portions (see FIG. 1 in the '527 patent, and FIG. 3 in the '568 patent). However, because of the proximity of a baby's head and mouth to the shoulder area when the baby is held against the shoulders, it is essential to completely cover the shoulder areas. Furthermore, because babies are typically held to face towards the back of a user, regurgitation of foods and excess drool from the baby's mouth tend to reach the upper back of the user as well.

In U.S. Pat. No. 5,100,710, another disposable bib is shown having a sheet-like structure dispensed from a roll, and having a neck portion 36 which is bounded by perforations 38 in a circular manner. Furthermore, the bib has a back extension perforation 40 and two shoulder perforations 42 which allow sufficient passage of the user's head therethrough. While the '710 patent arguably appears to provide protection to the upper back and shoulder areas of a user not provided in the '568 and '527 patents, it does not provide adequate means for controlling the coverage area to prevent curling of the sheet during use. Curling tendencies of sheets dispensed from rollers may be especially acute and may detract from the utility of providing garment protective coverage.

BRIEF SUMMARY OF THE INVENTION

It is an object of the present invention to provide a disposable garment-protecting cover which may be worn around the neck of a user for providing complete protective coverage of a user's chest, shoulders, and upper back.

It is a further object of the present invention to provide a disposable garment-protecting cover having three distinct regions for providing protective coverage of a user's chest, shoulders, and upper back, respectively.

A still further object of the present invention is to provide a disposable garment-protecting cover having a flexible and foldable sheet construction which is foldably transformable between a packaged configuration and a dispensed configuration.

A still further object of the present invention is to provide a disposable garment-protecting cover having vertical creases which controls against curling by forming a concave configuration which contours to a user's chest.

A still further object of the present invention is to provide a simple and low cost disposable garment-protecting cover which is easily manufactured by conventional manufacturing methods.

The present invention is for a disposable garment-protecting cover for protectively covering a user's upper torso when holding a baby thereagainst. The disposable garment-protecting cover has a sheet construction with front and back surfaces and comprises three regions: a lower region, middle region, and upper region. The lower region has a pair of opposing lower region side edges. The upper region is bifurcated into a pair of upper sections which are releasably securable to each other. And the middle region is between the upper and lower regions, and has a central aperture and a pair of shoulder sections on opposite sides of the central aperture. Each shoulder section has an outer side edge which is remotely positioned from the central aperture, and the bifurcation of the pair of upper sections allows passage through the upper region to the central aperture. The cover also comprises at least two vertical creases on the lower region forming at least three vertical sections thereof. The vertical creases angle the vertical sections toward the back surface of the lower region to form a substantially concave configuration thereof.

Furthermore, the sheet construction of the present invention may be dispensed from a dispenser, and is transformable between a packaged configuration in which the at least three vertical sections are collapsed in an overlapping folded manner along the at least two vertical creases and toward the back surface, and a dispensed configuration in which the at least three vertical sections are substantially unfolded from the packaged configuration to form a substantially concave configuration of the back surface of the lower region.

In this manner, when the disposable garment-protecting cover is donned with the user's neck positioned through the aperture, the lower region positioned against the user's chest, the upper region positioned against the user's upper back, the pair of shoulder sections positioned over the user's shoulders, and the bifurcated pair of upper sections releasably secured to each other, the substantially concave configuration of the back surface of the lower region substantially contours around the user's chest.

DESCRIPTION OF THE PREFERRED EMBODIMENTS

Figure 1:
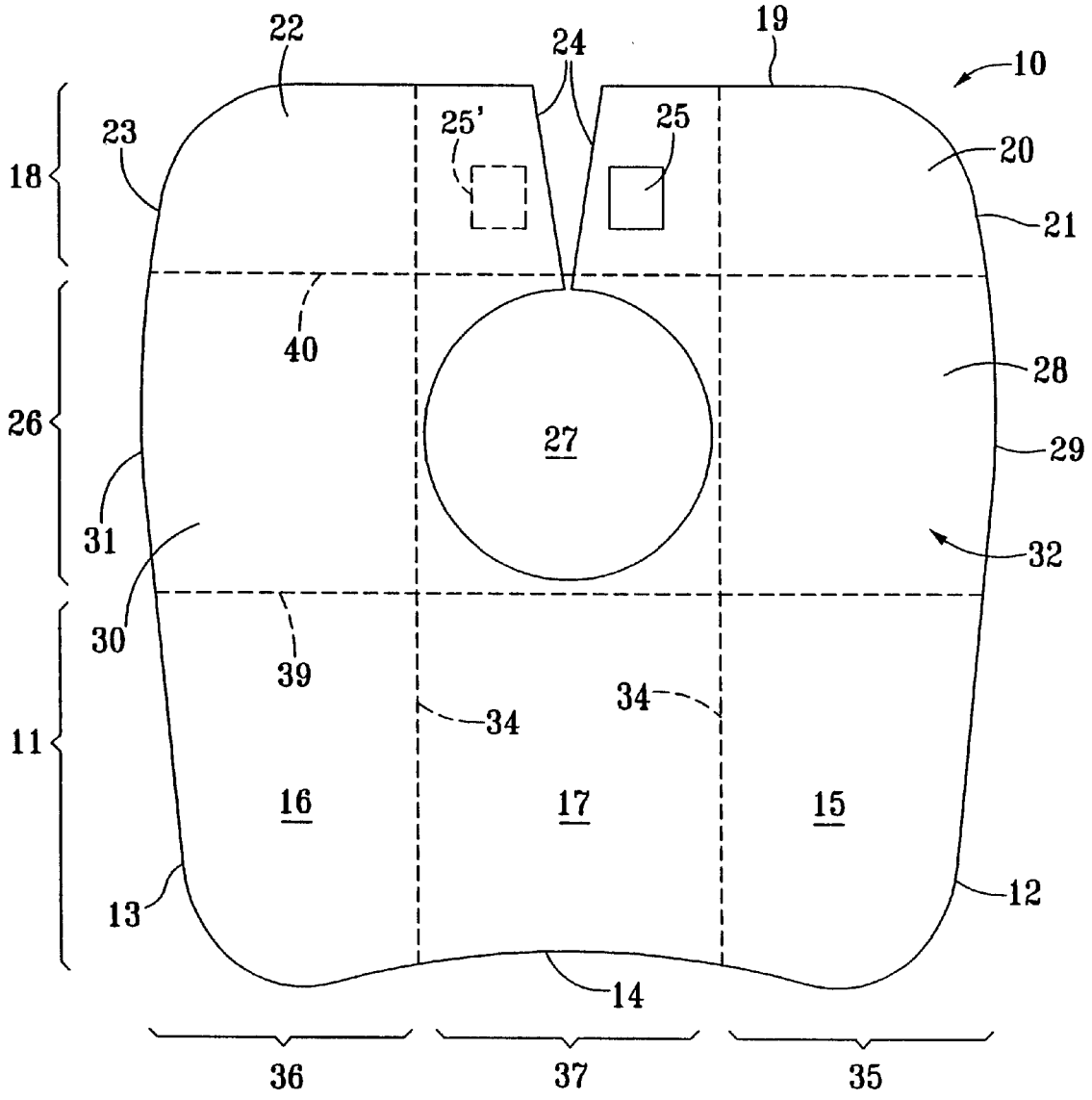
FIG. 1 is a plan view of a first preferred embodiment of the disposable garment-protecting cover which is laid flat prior to folding.

Referring now to the drawings, FIG. 1 shows a first preferred embodiment of the disposable garment-protecting cover, generally indicated at reference character 10, and hereinafter referred as "cover". In particular, FIG. 1 shows a plan view of the first preferred embodiment of the cover 10 when laid flat, such as against a plane surface, for illustrating the various regions and features thereof. It is notable that the cover 10 is preferably dispensed from and generally utilized as part of a dispensing system (not shown) comprising a plurality of such covers 10 stored in a dispenser having a dispensing aperture or other opening.

Figure 3:
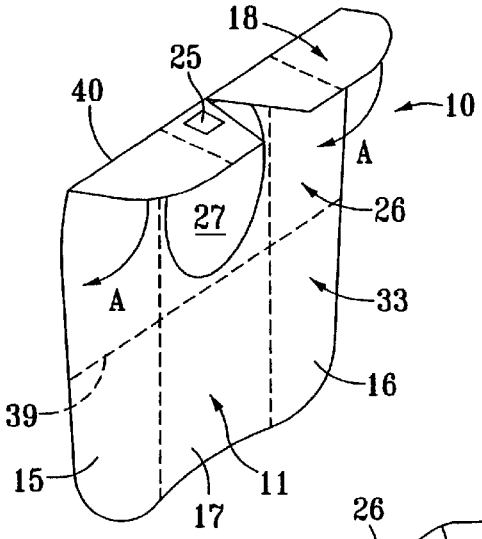
FIG. 3 is a back perspective view of the first preferred embodiment of the disposable garment-protecting cover with the upper region partially folded toward the back surface.
Figure 4:
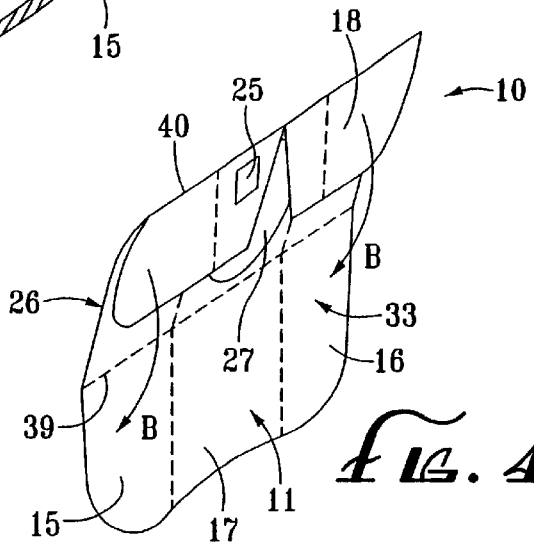
FIG. 4 is a back perspective view following FIG. 3 of the first preferred embodiment of the disposable garment-protecting cover with the upper region foldably collapsed against the middle region, and the middle region (together with the upper region) partially folded toward the back surface.

As can be seen in FIG. 1, the cover 10 has a sheet construction with a front surface 32 and a back surface 33 (see FIGS. 3 and 4). The sheet construction is of a substantially flexible quality while also being capable of maintaining a crease or fold formed thereon. And preferably, the sheet construction has a layered construction wherein the front surface 32 of the cover 10 has a liquid-absorbing quality, such as is known for many fibrous materials, and the back surface 33 has a non-absorbing, water-proof quality which prevents liquids from seeping through. It is appreciated that the lamination of such a layered construction is known in the relevant sheet manufacturing industries.

Furthermore, the cover 10 has three main regions which are generally in horizontal arrangement relative to each other, from a top edge 24 to a bottom edge 14 of the cover 10. The three regions include an upper region 18, a lower region 11, and a middle region 26 between the upper and lower regions. As can be best seen in FIG. 1, the middle region 26 has a central aperture 27, and a pair of shoulder sections 28, 30 on opposite sides of the central aperture 27. It is notable that each of the shoulder sections 28, 30 have a sufficient breadth to completely cover a corresponding left or right shoulder of a user. Furthermore, the upper region 18 has an upper region left side edge 21 and an upper region right side edge 23 opposite thereof, the middle region 26 has a middle region left side edge 29 and a middle region right side edge 31 opposite thereof, and the lower region 11 has a lower region left side edge 12 and a lower region right side edge 13 opposite thereof. It is notable that left and right designations follow the directional orientation of a user when wearing the cover 10.

As can be best seen in FIG. 1, the upper region 18 is bifurcated down the center, such as by cutting the upper region, to form an upper left section 20 and an upper right section 22. The split forms connector ends 24 on each of the upper left section 20 and upper right section 22, and allows passage through the upper region 18 to the central aperture 27. And on each of the connector ends 24 is provided means for releasably connecting to the other connector end. Preferably, hook and loop materials 25, 25', as is commonly known by the trademark Velcro, are utilized, with each connector end 24 having a hook or loop patch. It is appreciated that snap fasteners may alternatively be used.

The three regions 11, 18, 26 of the cover 10 are preferably divided by an upper horizontal crease 40 and a lower horizontal crease 39. In particular, the upper horizontal crease 40 foldably angles the upper region 18 and the middle region 26 relative to each other and toward the back surface 33 (see FIG. 3). Likewise, the lower horizontal crease 39 foldably angles the lower region 11 and the middle region 26 relative to each other and also toward the back surface 33 (see FIG. 4). In this manner, the upper and lower horizontal creases 39, 40 fold the three regions into an inverted U-shaped configuration as shown in FIG. 2, with the three regions positioned adjacent their respective coverage areas, i.e. chest, shoulder, and upper back areas of a user 43.

Figure 7:
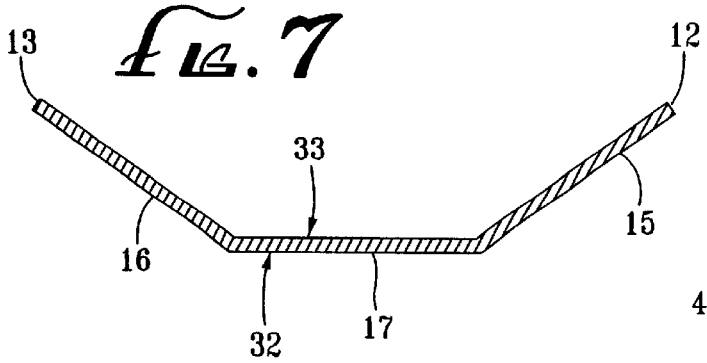
FIG. 7 is a cross-sectional view taken along the line 7—7 of FIG. 2, illustrating the concave curvature of the lower region toward the back surface.

Furthermore, as shown in FIG. 1, the sheet construction of the cover 10 also has at least two vertical creases 34 which form at least three vertical sections 35, 36, and 37. Preferably, the at least two vertical creases 34 and the at least three vertical sections are found only in the lower region 11 for purposes of the claimed invention. However, and alternatively, the at least two vertical creases 34 may extend trans-regionally across all three regions from the bottom edge 14 to the top edge 19. In any event, the lower region 11 is thus divided by the vertical creases 34 into three vertical sections: a left vertical section 15, a right vertical section 16, and a central vertical section 17. Similar to the upper and lower horizontal creases 40 and 39, the vertical creases 34 also foldably angle the left, central, and right vertical sections 15, 17, and 16, relative to an adjacent vertical section and toward the back surface 33 of the cover 10. As shown in FIG. 7, this angulation of the three vertical sections of the lower region 11 produces a concave configuration of the back surface 33 which contours around the chest area of a user. It is believed that this concave configuration improves structural rigidity and support of the lower region 11 to provide better control against inward or outward curling of the lower region 11.

Figure 6:
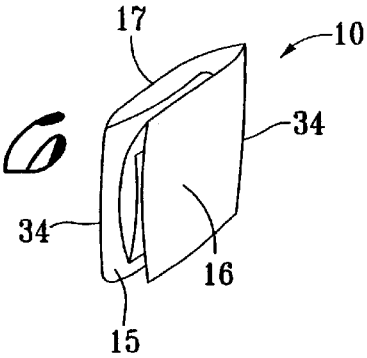
FIG. 6 is a perspective view following FIG. 5 of the first preferred embodiment of the disposable garment-protecting cover, in a packaged configuration.
Figure 5:
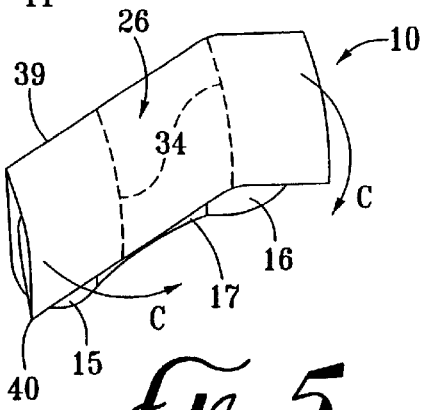
FIG. 5 is a back perspective view following FIG. 4 of the first preferred embodiment of the disposable garment-protecting cover with the middle region (together with the upper region) foldably collapsed against the lower region, and the three vertical sections partially folded toward the back surface.

As discussed above, the garment-protecting cover 10 is preferably utilized in conjunction with a dispenser and dispensing system (not shown). To this end, the cover 10 is transformable between a packaged configuration and a dispensed/use configuration. In the packaged configuration, (one embodiment of which is shown in FIG. 6), the at least three vertical sections are collapsed in an overlapping folded manner along the at least two vertical creases and toward the back surface. It is appreciated that such a foldably collapsed configuration may be placed in a dispenser with a plurality of other similarly foldably collapsed covers for dispensing single units in a manner known in the relevant art.

Figure 2:
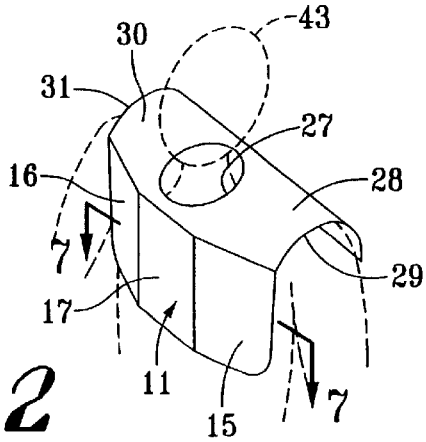
FIG. 2 is a front perspective view of the first preferred embodiment of the disposable garment-protecting cover, in a dispensed configuration positioned for use on a user.

And in the dispensed or use configuration, as shown in FIG. 2, the at least three vertical sections are substantially unfolded from a packaged configuration to form the substantially concave configuration of the back surface 33 of the lower region 11. Furthermore, in the dispensed configuration, the upper 18, middle 26, and lower 11 regions are also substantially unfolded along the upper 40 and lower 39 horizontal creases to produce the generally inverted U-shaped configuration by which the user's chest, shoulders and upper back areas are completely covered. It is notable that the term "substantially unfolded" as used herein and in the claims means that a once completely folded and collapsed configuration, i.e. having zero degree, is sufficiently unfolded to produce a relative angle measure less than 180 degrees of a plane configuration. Thus, and in particular, the three regions are unfolded to approximately ninety-degrees relative to each other along the upper and lower horizontal creases 40, 39 to produce the inverted U-shaped configuration. And the vertical sections are substantially unfolded relative to each other along the vertical creases 34 to produce the concave configuration.

In FIGS. 3–6, one preferred folding method is shown by which the cover 10 is transformed between packaged and dispensed configurations. Starting with a planar configuration similar to that shown in FIG. 1, FIG. 3 illustrates the upper region 18 being folded along the upper horizontal crease 40 toward the back surface 33, as indicated by fold arrows A. Next, FIG. 4 illustrates the middle region 26 being folded along the lower horizontal crease 39 toward the back surface 33, as indicated by fold arrows B. Arrows A and B and the collapsed folds produced thereby result in the preferred inverted U-shaped configuration shown in FIG. 2. Next, in FIG. 5, the horizontally folded construction is further foldably collapsed along the at least two vertical creases 34 following the fold arrows C to produce the packaged configuration shown in FIG. 6. It is notable that the transformation from the packaged configuration to the dispensed configuration follows the same steps, albeit in reverse order. And it is further notable that this particular folding method will produce the required vertical creases 34 on the lower region 11, i.e. folded toward the back surface 33. However, because of the previously formed horizontal folds, the intersecting portions of the vertical sections and the three horizontal regions will be angled toward the front surface 32 and not the back surface 33. It is believed however, that this byproduct of folding sheets does not interfere with the concave dispensed configuration of the lower region 11 which is necessary for operation of the present invention.

Figure 8:
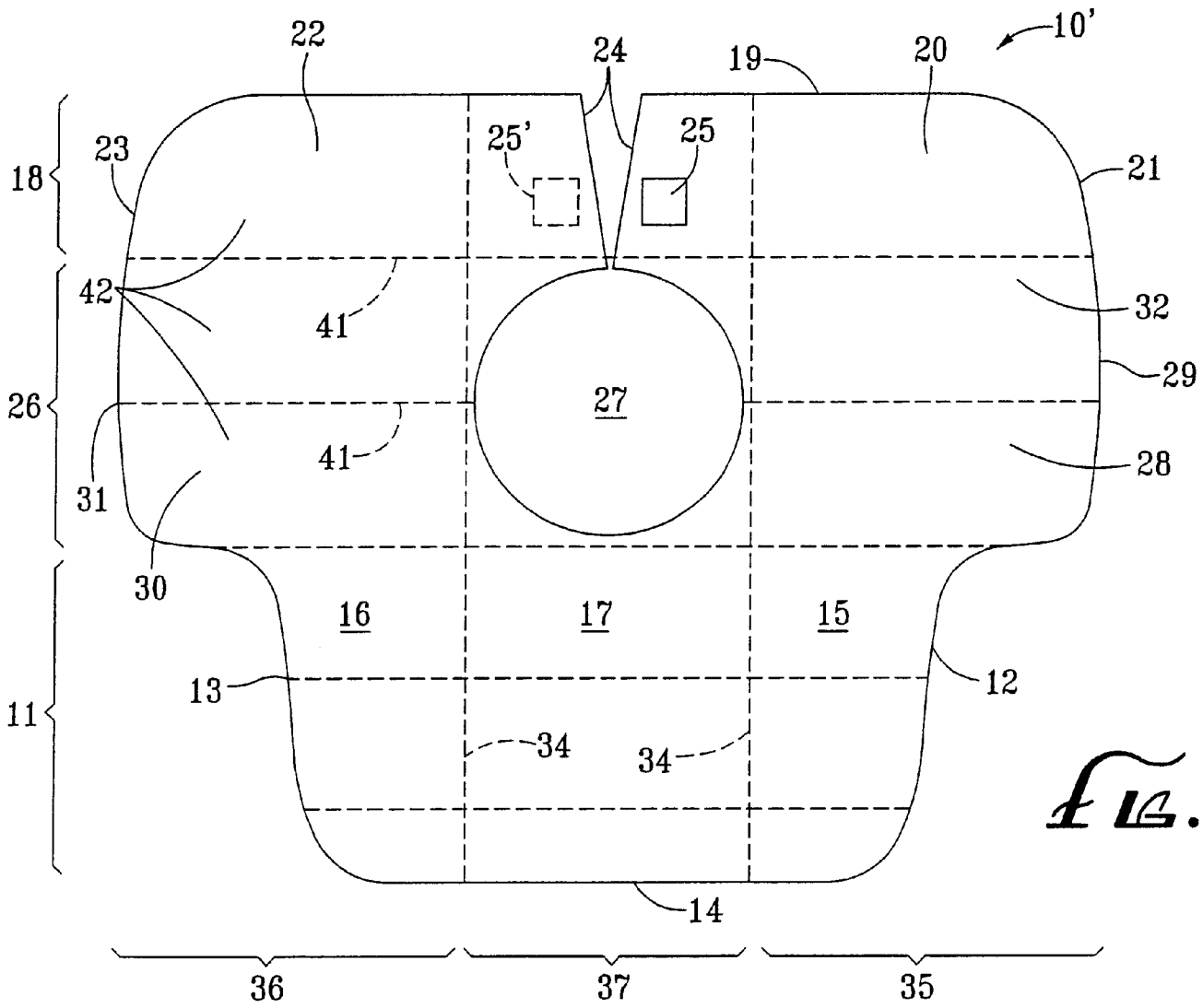
FIG. 8 is a plan view of a second preferred embodiment of the disposable garment-protecting cover which is laid flat prior to folding.

FIG. 8 shows a second preferred embodiment of the disposable garment-protecting cover, generally indicated at reference character 10'. As can be seen, the left side edge 29 and the right side edge 31 of the middle region 26 is spaced a greater distance from the at least two vertical creases 34 than a corresponding side edge 12, 13 of the lower region 11. Alternatively, each side edge 12, 13 of the lower region 11 may taper out to a corresponding side edge 29, 31 of the middle region 26. In any event, this produces a middle region 26 with a greater breadth than the lower region 11. It is believed that this arrangement and configuration provides complete shoulder coverage while enabling greater range of arm motion, especially in a forward direction. The relatively narrow width of the lower region 11 enables a user to better hold a baby without disrupting the contouring configuration and operation of the lower region 11.

Furthermore, FIG. 8 illustrates another preferred embodiment having a plurality of horizontal creases 41 which form a plurality of horizontal sections 42. The plurality of horizontal creases include the upper horizontal crease 40 and the lower horizontal crease 39, and are preferably equally spaced relative to each other. It is believed that the plurality of horizontal creases 41 and sections 42 provide greater storability and compactness when used with a dispenser and dispensing system. In one particular embodiment, the plurality of horizontal creases 41 may alternate to fold the plurality of horizontal sections 42 toward the front 32 and back 33 surfaces in a zigzag pattern.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A disposable garment-protecting cover for protectively covering a user's upper torso when holding a baby thereagainst, said disposable garment-protecting cover having a sheet construction with front and back surfaces and comprising:

a lower region with a pair of opposing lower region side edges;

an upper region bifurcated into a pair of upper sections which are releasably securable to each other;

a middle region between the upper and lower regions, the middle region having a central aperture and a pair of shoulder sections on opposite sides of the central aperture, each shoulder section having an outer side edge remotely positioned from the central aperture, and the bifurcation of the pair of upper sections allowing passage through the upper region to the central aperture; and at least two vertical creases on the lower region forming at least three vertical sections thereof, the vertical creases angling the vertical sections toward the back surface of the lower region to form a substantially concave configuration thereof, whereby, upon donning the disposable garment-protecting cover with the user's neck positioned through the aperture, the lower region positioned against the user's chest, the upper region positioned against the user's upper back, the pair of shoulder sections positioned over the user's shoulders, and the bifurcated pair of upper sections releasably secured to each other, the substantially concave configuration of the back surface of the lower region substantially contours around the user's chest.

2. The disposable garment-protecting cover as in claim 1, wherein the lower and middle regions are divided by an upper horizontal crease, and the upper and middle regions are divided by a lower horizontal crease, said upper and lower horizontal creases angling the upper, lower, and middle regions toward the back surface.

3. The disposable garment-protecting cover as in claim 2, further comprising a plurality of horizontal creases forming a plurality of horizontal sections, wherein the plurality of horizontal creases includes the upper and lower horizontal creases.

4. The disposable garment-protecting cover as in claim 1, wherein each of the outer side edges of the pair of shoulder sections is spaced a greater distance from the vertical creases than a corresponding lower region side edge, whereby broad coverage of the user's shoulders is enabled without inhibiting motion of the user's arms.

5. The disposable garment-protecting cover as in claim 1, wherein the at least two vertical creases are trans-regional creases which extend vertically across the upper, lower, and middle regions.

6. A disposable garment-protecting cover for protectively covering a user's upper torso when holding a baby thereagainst and adapted for dispensing from a dispenser, said disposable garment-protecting cover comprising:

a sheet construction having front and back surfaces, a lower region with a pair of opposing lower region side edges, an upper region bifurcated into a pair of upper sections which are releasably securable to each other, a middle region between the upper and lower regions, the middle region having a central aperture and a pair of shoulder sections on opposite sides of the central aperture, each shoulder section having an outer side edge remotely positioned from the central aperture and the bifurcation of the pair of upper sections allowing passage through the upper region to the central aperture, and at least two vertical creases on the lower region forming at least three vertical sections thereof, the sheet construction being transformable between a packaged configuration in which the at least three vertical sections are collapsed in an overlapping folded manner along the at least two vertical creases and toward the back surface, and a dispensed configuration in which the at least three vertical sections are substantially unfolded from the packaged configuration to form a substantially concave configuration of the back surface of the lower region, whereby, upon donning the disposable garment-protecting cover with the user's neck positioned through the aperture, the lower region positioned against the user's chest, the upper region positioned against the user's upper back, the pair of shoulder sections positioned over the user's shoulders, and the bifurcated pair of upper sections releasably secured to each other, the substantially concave configuration of the back surface of the lower region substantially contours around the user's chest.

7. The disposable garment-protecting cover as in claim 6, wherein the lower and middle regions are divided by an upper horizontal crease, and the upper and middle regions are divided by a lower horizontal crease, said upper and lower horizontal creases angling the upper, lower, and middle regions toward the back surface.

8. The disposable garment-protecting cover as in claim 7, further comprising a plurality of horizontal creases forming a plurality of horizontal sections, wherein the plurality of horizontal creases includes the upper and lower horizontal creases.

9. The disposable garment-protecting cover as in claim 6, wherein each of the outer side edges of the pair of shoulder sections is spaced a greater distance from the vertical creases than a corresponding lower region side edge, whereby broad coverage of the user's shoulders is enabled without inhibiting motion of the user's arms.

10. The disposable garment-protecting cover as in claim 6, wherein the at least two vertical creases are trans-regional creases which extend vertically across the upper, lower, and middle regions.

11. A disposable garment-protecting cover for protectively covering a user's upper torso when holding a baby thereagainst and adapted for dispensing from a dispenser, said disposable garment-protecting cover comprising:

a sheet construction having front and back surfaces, a lower region with a pair of opposing lower region side edges, an upper region bifurcated into a pair of upper sections which are releasably securable to each other, a middle region between the upper and lower regions with the middle region having a central aperture and a pair of shoulder sections on opposite sides of the central aperture, each shoulder section having an outer side edge remotely positioned from the central aperture and the bifurcation of the pair of upper sections allowing passage through the upper region to the central aperture, and at least two vertical creases on the lower region forming at least three vertical sections thereof wherein each of the outer side edges is spaced a greater distance from the vertical creases than a corresponding lower region side edge, the sheet construction being transformable between a packaged configuration in which the at least three vertical sections are collapsed in an overlapping folded manner along the at least two vertical creases and toward the back surface, and a dispensed configuration in which the at least three vertical sections are substantially unfolded from the packaged configuration to form a substantially concave configuration of the back surface of the lower region, whereby, upon donning the disposable garment-protecting cover with the user's neck positioned through the aperture, the lower region positioned against the user's chest, the upper region positioned against the user's upper back, the pair of shoulder sections positioned over the user's shoulders, and the bifurcated pair of upper sections releasably secured to each other, the substantially concave configuration of the back surface of the lower region substantially contours around the user's chest, and the greater spacing of each of the outer side edges from the vertical creases than a corresponding lower region side edge enables broad coverage of the user's shoulders without inhibiting motion of the user's arms.

12. The disposable garment-protecting cover as in claim 11, wherein the lower and middle regions are divided by an upper horizontal crease, and the upper and middle regions are divided by a lower horizontal crease, said upper and lower horizontal creases angling the upper, lower, and middle regions toward the back surface.

13. The disposable garment-protecting cover as in claim 12, further comprising a plurality of horizontal creases forming a plurality of horizontal sections, wherein the plurality of horizontal creases includes the upper and lower horizontal creases.

14. The disposable garment-protecting cover as in claim 11, wherein the at least two vertical creases are trans-regional creases which extend vertically across the upper, lower, and middle regions.

* * * * *